US008022639B2

(12) United States Patent
Mangiaracina

(10) Patent No.: US 8,022,639 B2
(45) Date of Patent: Sep. 20, 2011

(54) DIMMING FLUORESCENT BALLAST SYSTEM WITH SHUTDOWN CONTROL CIRCUIT

(75) Inventor: Anthony Mangiaracina, Mobile, AL (US)

(73) Assignee: Nextek Power Systems, Inc., Hauppauge, NY (US)

( * ) Notice: Subject to any disclaimer, the term of this patent is extended or adjusted under 35 U.S.C. 154(b) by 575 days.

(21) Appl. No.: 12/214,042

(22) Filed: Jun. 16, 2008

(65) Prior Publication Data

US 2009/0309511 A1 Dec. 17, 2009

(51) Int. Cl.
*H05B 41/36* (2006.01)

(52) U.S. Cl. ..... 315/291; 315/209 R; 315/224; 315/225; 315/299; 315/307; 361/92

(58) Field of Classification Search ..... 315/291, 315/299, 307, 362, 209 R, 224, DIG. 4, DIG. 5; 361/92

See application file for complete search history.

(56) References Cited

U.S. PATENT DOCUMENTS 4,087,702 A * 5/1978 Kirby et al. ..... 327/459
5,461,287 A 10/1995 Russell et al.
5,485,058 A * 1/1996 Watson et al. ..... 315/194
5,493,181 A 2/1996 Shackle et al.
5,550,436 A 8/1996 Houk
5,559,395 A 9/1996 Venkitasubrahmanian et al.
5,666,044 A 9/1997 Tuozzolo
6,031,342 A 2/2000 Ribarich et al.
6,836,082 B2 * 12/2004 Buij et al. ..... 315/308
6,949,888 B2 * 9/2005 Ribarich ..... 315/291
6,963,178 B1 11/2005 Lev et al.
7,170,018 B2 * 1/2007 Ilkhanov ..... 200/18
7,482,758 B2 * 1/2009 Hua et al. ..... 315/119
2004/0061453 A1 4/2004 Konopka et al.
2004/0232855 A1 11/2004 Ribarich et al.

* cited by examiner

*Primary Examiner* — Douglas W Owens
*Assistant Examiner* — Thai Pham
(74) *Attorney, Agent, or Firm* — Kirschstein, et al.

(57) ABSTRACT

A ballast system for, and a method of, controlling illumination of a lamp, include a dimmer switch having an actuator settable at different settings corresponding to different output voltages across the dimmer switch, a dimming electronic ballast operatively connected to an electrical power source and to the dimmer switch for dimming the lamp upon setting of the actuator, and a shutdown circuit, preferably provided in the ballast, for measuring the output voltages across the dimmer switch, and for automatically powering the ballast off and, in turn, for turning the lamp off when one of the voltages measured by the shutdown circuit does not exceed a reference voltage that corresponds to one of the settings of the actuator.

20 Claims, 2 Drawing Sheets

DIMMING FLUORESCENT BALLAST SYSTEM WITH SHUTDOWN CONTROL CIRCUIT

FIELD OF THE INVENTION

The present invention generally relates to ballast systems for powering lamps and, more particularly, to ballast systems for dimming fluorescent lamps at adjustable illumination levels and, still more particularly, to providing such dimming ballast systems with a shutdown control capability.

BACKGROUND OF THE INVENTION

Dimming of lighting illumination is desirable for both energy efficiency and user preference, as well as for compensating for variations in natural lighting. In existing ballast systems for powering fluorescent lamps at adjustable illumination levels, different methods are used for dimming control. One popular method of dimming control employs a phase-control device, such as a triac. The phase-control device is used to modify a firing phase angle or "on" time of each half cycle of an alternating current (AC) powering signal. A dimming ballast system, in turn, controllably dims a fluorescent lamp based on the firing phase angle.

Another popular method of dimming control is based on a direct current (DC) input, such as a 0 to 48 volt DC input, distinct from an AC powering signal. In this method, a fluorescent lamp is dimmed based on the magnitude of the voltage of the DC input.

FIG. 1 depicts a known dimming ballast system 10 for powering a fluorescent lamp 12. The system 10 includes an electronic dimming ballast 14 having two pairs of output wires, each pair being connected to respective opposite ends of the lamp 12, and a dimmer switch 16, essentially a potentiometer having a manual slide 18, connected by a pair of wires 28 to the ballast 14.

An AC to DC converter 20 converts an input AC voltage, typically 90 to 265 volts AC 50/60 Hz, to a lower DC voltage, for example, 24 volts DC. The 24 volts DC power is supplied by a pair of wires via a wall switch 24 to a contact relay 22 that is, in turn, connected by a pair of wires 30 to the ballast 14. The 24 volts DC power is also supplied by another pair of wires to a low voltage isolated power supply 26. The relay 22 is connected by a wire 32 to the dimmer switch 16 and by a wire 34 to the power supply 26. The power supply 26 is also connected by a wire 36 to the dimmer switch 16.

The dimmer switch 16 regulates the brightness level of the lamp 12 by sliding the slide 18 between high and low position levels. When the slide 18 is set at its lowest level, the relay 22 and the power supply 26 cooperate to turn off the ballast 14 and, in turn, the lamp 12.

As advantageous as the known dimming ballast systems have been in dimming and shutting down fluorescent lamps, there is a high required capital and labor cost associated with providing and installing the relay 22 and the power supply 26, together with their associated wiring. It would be desirable to eliminate such additional components and wiring, as well as to reduce the size of the overall circuit to save cost, weight and space and to provide greater efficiency.

SUMMARY OF THE INVENTION

One feature of the present invention resides, briefly stated, in a ballast system for, and a method of, controlling illumination of a lamp, such as a fluorescent lamp. The system includes a dimmer switch having an actuator settable at different settings corresponding to different output voltages across the dimmer switch. For example, the actuator may be a slide mounted on the dimmer switch for manual sliding movement along a track, and the different settings are different positions along the track. The system further includes a dimming electronic ballast operatively connected to an electrical power source, such as a DC power source, and to the dimmer switch, for dimming the lamp upon setting of the actuator.

In accordance with one aspect of this invention, a shutdown circuit is provided for measuring the output voltages across the dimmer switch, and for automatically powering the ballast off and, in turn, for turning the lamp off when one of the voltages measured by the shutdown circuit does not exceed a reference voltage that corresponds to one of the settings of the actuator. Preferably, the shutdown circuit is provided in the ballast. Also, said one setting is preferably a lowermost position on the track, and the reference voltage is on the order of 0.7 volts. The ballast advantageously includes a digital controller, such as a microprocessor, and the shutdown circuit is operative for generating a disable signal to disable the controller when said one measured voltage is below the reference voltage.

In one embodiment, the shutdown circuit includes an electronic component changeable from a default state to a switched state when said one measured voltage is below the reference voltage. The electronic component may be a transistor having a threshold voltage on the order of the reference voltage. In another embodiment, the shutdown circuit may include a pair of transistors, one of which has a threshold voltage on the order of the reference voltage.

In accordance with another feature of this invention, the method of controlling illumination of the lamp is performed by setting an actuator on a dimmer switch at different settings corresponding to different output voltages across the dimmer switch, by dimming the lamp upon setting of the actuator by operatively connecting a dimming electronic ballast to an electrical power source and to the dimmer switch, by measuring the output voltages across the dimmer switch with a shutdown circuit, and by automatically powering the ballast off and, in turn, for turning the lamp off when one of the voltages measured by the shutdown circuit does not exceed a reference voltage that corresponds to one of the settings of the actuator. Preferably, the method includes mounting the shutdown circuit in the ballast.

Still another feature of this invention resides in the dimming electronic ballast itself. The ballast is installed in a system for controlling illumination of a lamp. The system includes a dimmer switch having an actuator settable at different settings corresponding to different output voltages across the dimmer switch for dimming the lamp upon setting of the actuator, and an electrical power source operatively connected to the ballast and to the dimmer switch. The novel ballast itself includes a shutdown circuit in the ballast, for measuring the output voltages across the dimmer switch, and for automatically powering the ballast off and, in turn, for turning the lamp off when one of the voltages measured by the shutdown circuit does not exceed a reference voltage that corresponds to one of the settings of the actuator.

By providing, and preferably mounting, the shutdown circuit in the ballast, the high capital and labor cost associated with providing and installing the relay 22 and the power supply 26, together with their associated wiring, as described above in connection with FIG. 1, are eliminated. The size, cost, weight and space of the overall system is reduced, and greater efficiency is achieved.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENTS

Figure 1:
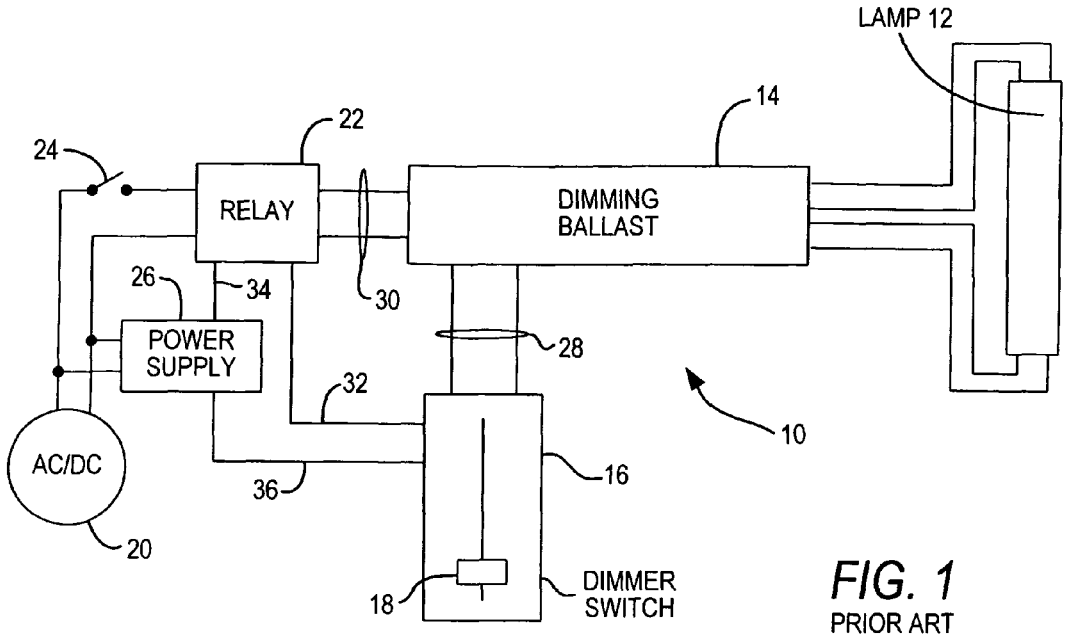
FIG. 1 PRIOR ART
FIG. 1 is an electrical schematic of a known dimming electronic ballast system in accordance with the prior art.
Figure 2:
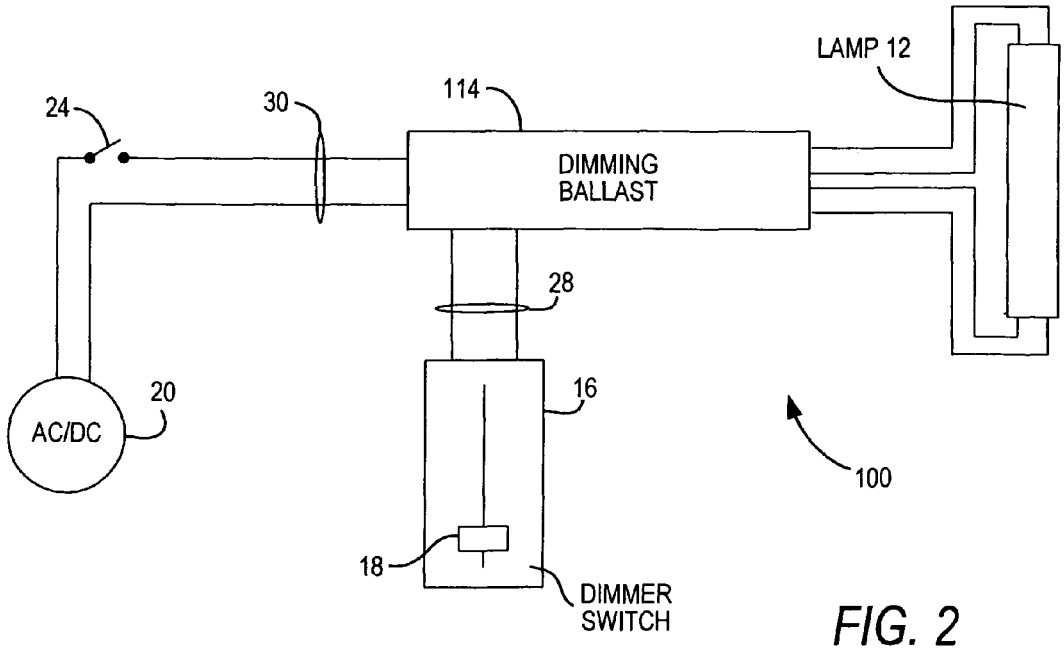
FIG. 2 is an electrical schematic of a dimming electronic ballast system in accordance with the present invention.

Referring now to FIG. 2 of the drawings, reference numeral 100 generally identifies a ballast system for controlling illumination of a lamp, such as a fluorescent lamp 12. The system 100 includes a dimmer switch 16 having an actuator 18 settable at different settings corresponding to different output voltages across the dimmer switch 16. For example, the actuator 18 may be a slide mounted on the dimmer switch 16 for manual sliding movement along a track, and the different settings are different positions along the track. The system 100 further includes a dimming electronic ballast 114 operatively connected via a wall switch 24 to an electrical power source 20, such as a DC power source, and to the dimmer switch 16, for dimming the lamp 12 upon setting of the actuator 18. Like reference numerals have been used in FIGS. 1-2 to identify like parts.

Figure 3:
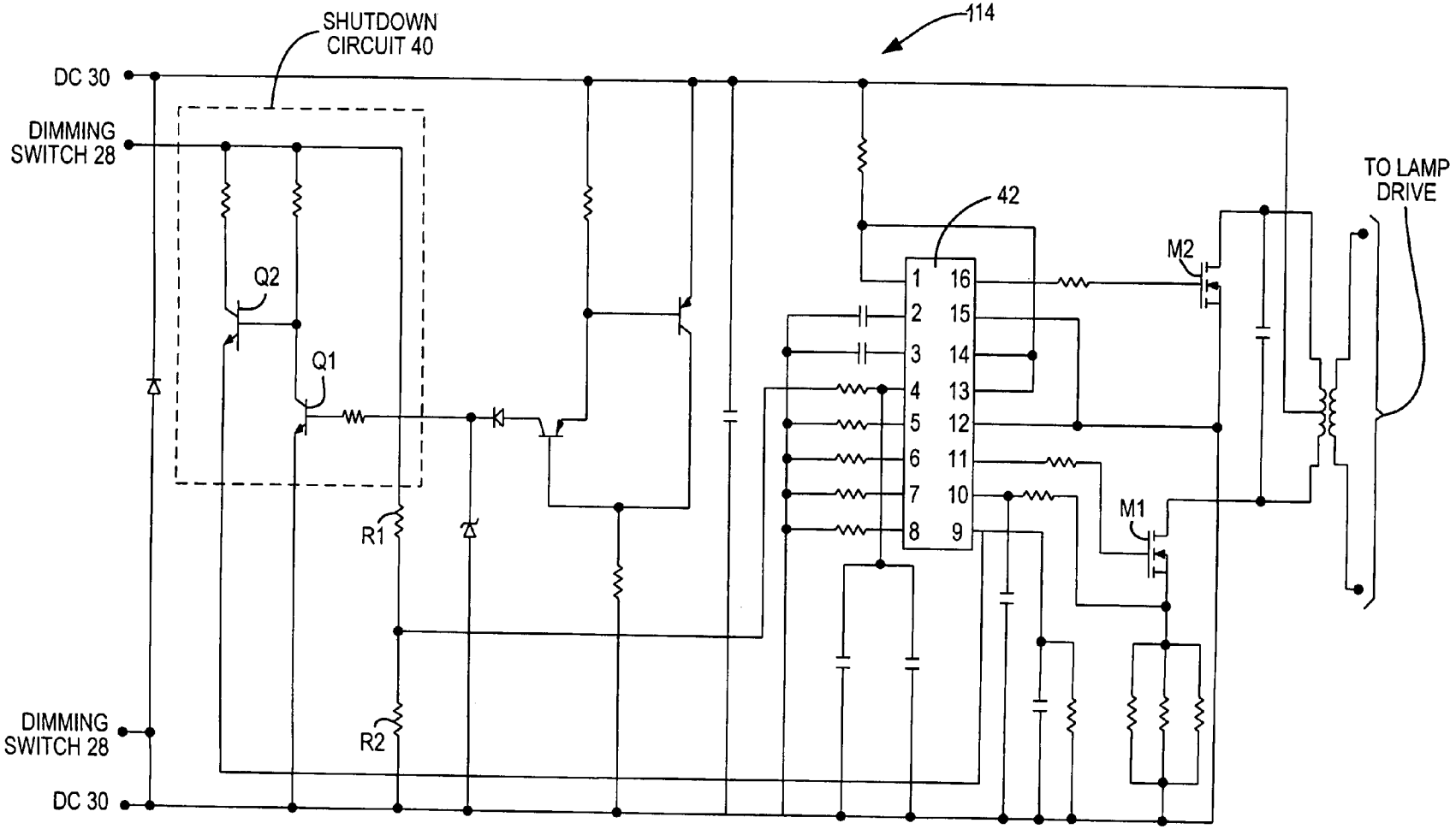
FIG. 3 is a circuit within the ballast used in the system of FIG. 2.

In accordance with one aspect of this invention, a shutdown circuit 40, as depicted and enclosed by dashed lines in FIG. 3, is preferably, but not necessarily, provided in the ballast 114. The shutdown circuit 40 is operative for measuring the output voltages across the wires 28 across the dimmer switch 16, and for automatically powering the ballast 114 off and, in turn, for turning the lamp 12 off when one of the voltages measured by the shutdown circuit 40 does not exceed a reference voltage that corresponds to one of the settings of the actuator 18. Preferably, said one setting is a lowermost position on the track, and the reference voltage is on the order of 0.7 volts. The ballast 114 advantageously includes a digital controller 42, such as a microprocessor, and the shutdown circuit 40 is operative for generating a disable signal to disable the controller 42 when said one measured voltage is below the reference voltage.

In one embodiment, the shutdown circuit 40 includes an electronic component changeable from a default state to a switched state when said one measured voltage is below the reference voltage. The electronic component may be a transistor having a threshold voltage on the order of the reference voltage. In another embodiment, the shutdown circuit 40 may include, as illustrated in FIG. 3, a pair of transistors Q1 and Q2, one of which has a threshold voltage on the order of the reference voltage. As shown, the base of transistor Q2 is connected to the collector of transistor Q1.

In a default mode, the actuator 18 can be positioned anywhere along the track, except at its lowermost position in the preferred embodiment. In the default mode, the voltage across the wires 28 is greater than the reference voltage, e.g., 0.7 volts, and, as a result, transistor Q1 is biased on, and transistor Q2 is switched off. With transistor Q2 off, no control signal is output from the transistor Q2 and, hence, no control signal is fed to pin 9 of the controller 42. This condition enables the controller 42 to stay energized and on, thereby powering the lamp at an illumination level determined by the position of the actuator 18.

However, when the actuator 18 is positioned at its lowermost position, the voltage across the wires 28 is equal to or less than the reference voltage, e.g., 0.7 volts. In this switched mode, transistor Q1 is switched off because it is biased below its threshold voltage, and the transistor Q2 is biased on. With transistor Q2 on, a control signal is output from the transistor Q2 and, hence, the control signal is fed to pin 9 of the controller 42. This condition toggles the controller 42 to be deenergized and off, thereby powering the lamp off.

By providing, and preferably mounting, the shutdown circuit 40 in the ballast 114, the high capital and labor cost associated with providing and installing the relay 22 and the power supply 26, together with their associated wiring, as described above in connection with FIG. 1, are eliminated. The size, cost, weight and space of the overall system is reduced, and greater efficiency is achieved.

The operation of the controller 42 is otherwise known. The output voltage across the wires 28 is divided by a power divider R1, R2 and is conducted to input pin 4. The magnitude of the voltage on input pin 4 causes the controller 42 to output a drive current at output pins 11, 16 to drive MOSFETS M1, M2 and, in turn, to drive the lamp 12.

It will be understood that each of the elements described above, or two or more together, also may find a useful application in other types of constructions differing from the types described above.

While the invention has been illustrated and described as embodied in a ballast system for, and a method of, controlling illumination of a lamp, as well as a ballast employed in such a system, it is not intended to be limited to the details shown, since various modifications and structural changes may be made without departing in any way from the spirit of the present invention.

For example, rather than using the transistors described above, the shutdown circuit 40 could comprise a zener diode, or a MOSFET, or a comparator, or any other circuit component that enables switching to occur upon detection of a voltage relative to a predetermined reference value.

Also, although the wall switch 24 has been shown as being connected to a single ballast system 100, in practice, multiple ballast systems 100 can be and are connected to the wall switch 24.

Still further, although the invention has been described and illustrated in connection with a DC ballast system, it could equally well be applied to an AC ballast system.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims.

I claim:

1. A ballast system for controlling illumination of a lamp, comprising:

a dimmer switch having an actuator settable at different settings corresponding to different output voltages across the dimmer switch;

a dimming electronic ballast operatively connected to an electrical power source and to the dimmer switch, for dimming the lamp upon setting of the actuator; and a shutdown circuit for measuring the output voltages across the dimmer switch, and for automatically powering the ballast off and, in turn, for turning the lamp off when one of the voltages measured by the shutdown circuit does not exceed a reference voltage that corresponds to one of the settings of the actuator.

2. The ballast system of claim 1, wherein the actuator is a slide mounted on the dimmer switch for manual sliding movement along a track, and wherein the different settings are different positions along the track.

3. The ballast system of claim 2, wherein said one setting is a lowermost position on the track.

4. The ballast system of claim 1, wherein the ballast includes a digital controller, and wherein the shutdown circuit is operative for generating a disable signal to disable the controller when said one measured voltage is below the reference voltage.

5. The ballast system of claim 1, wherein the shutdown circuit is provided in the ballast.

6. The ballast system of claim 1, wherein the shutdown circuit includes an electronic component changeable from a default state to a switched state when said one measured voltage is below the reference voltage.

7. The ballast system of claim 6, wherein the electronic component is a transistor having a threshold voltage on the order of the reference voltage.

8. The ballast system of claim 1, wherein the shutdown circuit includes a pair of transistors, one of which has a threshold voltage on the order of the reference voltage.

9. A method of controlling illumination of a lamp, comprising the steps of:

setting an actuator on a dimmer switch at different settings corresponding to different output voltages across the dimmer switch;

dimming the lamp upon setting of the actuator by operatively connecting a dimming electronic ballast to an electrical power source and to the dimmer switch; and measuring the output voltages across the dimmer switch with a shutdown circuit, and automatically powering the ballast off and, in turn, for turning the lamp off when one of the voltages measured by the shutdown circuit does not exceed a reference voltage that corresponds to one of the settings of the actuator.

10. The method of claim 9, and configuring the actuator as a slide mounted on the dimmer switch for manual sliding movement along a track, and configuring the different settings as different positions along the track.

11. The method of claim 10, and configuring said one setting as a lowermost position on the track.

12. The method of claim 9, and providing the ballast with a digital controller, and generating a disable signal to disable the controller when said one measured voltage is below the reference voltage.

13. The method of claim 9, and mounting the shutdown circuit in the ballast.

14. The method of claim 9, and configuring the shutdown circuit with an electronic component changeable from a default state to a switched state when said one measured voltage is below the reference voltage.

15. The method of claim 14, and configuring the electronic component as a transistor having a threshold voltage on the order of the reference voltage.

16. The method of claim 9, and configuring the shutdown circuit as a pair of transistors, one of which has a threshold voltage on the order of the reference voltage.

17. A dimming electronic ballast in a system for controlling illumination of a lamp, the system including a dimmer switch having an actuator settable at different settings corresponding to different output voltages across the dimmer switch for dimming the lamp upon setting of the actuator, and an electrical power source operatively connected to the ballast and to the dimmer switch, the ballast comprising:

a shutdown circuit in the ballast, for measuring the output voltages across the dimmer switch, and for automatically powering the ballast off and, in turn, for turning the lamp off when one of the voltages measured by the shutdown circuit does not exceed a reference voltage that corresponds to one of the settings of the actuator.

18. The ballast of claim 17, wherein the shutdown circuit includes an electronic component changeable from a default state to a switched state when said one measured voltage is below the reference voltage.

19. The ballast of claim 18, wherein the electronic component is a transistor having a threshold voltage on the order of the reference voltage.

20. The ballast of claim 17, wherein the shutdown circuit includes a pair of transistors, one of which has a threshold voltage on the order of the reference voltage.

* * * * *